US010947823B2

(12) United States Patent
Greci et al.

(10) Patent No.: US 10,947,823 B2
(45) Date of Patent: Mar. 16, 2021

(54) EROSIVE SLURRY DIVERTER

(71) Applicant: Halliburton Energy Services, Inc., Houston, TX (US)

(72) Inventors: Stephen Michael Greci, Little Elm, TX (US); Thomas Jules Frosell, Irving, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 282 days.

(21) Appl. No.: 16/084,865

(22) PCT Filed: Aug. 3, 2017

(86) PCT No.: PCT/US2017/045325
§ 371 (c)(1),
(2) Date: Sep. 13, 2018

(87) PCT Pub. No.: WO2019/027463
PCT Pub. Date: Feb. 7, 2019

(65) Prior Publication Data

US 2019/0309605 A1 Oct. 10, 2019

(51) Int. Cl.
*E21B 43/04* (2006.01)

(52) U.S. Cl.
CPC ..... *E21B 43/045* (2013.01); *E21B 43/04* (2013.01)

(58) Field of Classification Search
CPC ..... E21B 17/10; E21B 43/04; E21B 43/045
See application file for complete search history.

(56) References Cited

U.S. PATENT DOCUMENTS 4,105,069 A 8/1978 Baker
5,636,691 A 6/1997 Hendrickson et al.
(Continued)

FOREIGN PATENT DOCUMENTS

EP 0935050 8/1999
WO 2017023402 2/2017

OTHER PUBLICATIONS

Study on the Flow Characteristics and Erosion Phenomenon of Frac Sleeve by Using a CFD Approach, by Zheng et al. published in the International Journal of Control and Automation vol. 8, No. 1 (2015), p. 251-262.
(Continued)

*Primary Examiner* — Shane Bomar
(74) *Attorney, Agent, or Firm* — Scott Richardson; C. Tumey Law Group PLLC

(57) ABSTRACT

A downhole tool may comprise a body comprising an outer wall and a first passage that extends longitudinally in the body, wherein a fluid slurry traverses a flow path in the body of the downhole tool through the first passage. The downhole tool may further comprise a diverter disposed in the body, wherein the diverter comprises at least one channel and the diverter extends from the outside wall of the body into the flow path of the first passage operable to direct the fluid slurry from the first passage to a location outside the downhole tool. A gravel packing system may comprise a packer and a conveyance comprising a downhole tool. The downhole tool may comprise a body comprising an outer wall and a first passage that extends longitudinally in the body and a diverter disposed in the body.

20 Claims, 4 Drawing Sheets

(56) References Cited

U.S. PATENT DOCUMENTS 5,842,516 A 12/1998 Jones
6,253,851 B1* 7/2001 Schroeder, Jr. ..... E21B 43/045 166/278
6,491,097 B1 12/2002 Oneal et al.
7,096,946 B2 8/2006 Jasser et al.
7,185,704 B2 3/2007 Bigelow et al.
7,373,989 B2 5/2008 Setterberg
7,419,003 B2 9/2008 Russell
7,559,357 B2 7/2009 Clem
8,322,418 B2 12/2012 Martinez et al.
8,371,369 B2 2/2013 Clem et al.
9,097,104 B2 8/2015 Royer et al.
2002/0096328 A1* 7/2002 Echols ..... E21B 43/045 166/278
2002/0157836 A1* 10/2002 Royer ..... E21B 43/088 166/369
2003/0075324 A1 4/2003 Dusterhoft et al.
2005/0082060 A1* 4/2005 Ward ..... E03B 3/18 166/278
2005/0087348 A1 4/2005 Bigelow et al.
2006/0191685 A1 8/2006 Coronado
2006/0213671 A1 9/2006 Li et al.
2006/0231253 A1* 10/2006 Vilela ..... E21B 43/25 166/278
2007/0187095 A1* 8/2007 Walker ..... E21B 43/25 166/278
2008/0099194 A1* 5/2008 Clem ..... E21B 43/045 166/51
2008/0314588 A1 12/2008 Langlais et al.
2009/0133875 A1* 5/2009 Tibbles ..... E21B 43/04 166/278
2011/0266374 A1 11/2011 Hammer
2012/0103606 A1* 5/2012 van Petegem ..... E21B 43/04 166/278
2013/0248178 A1* 9/2013 Hecker ..... E21B 43/045 166/278
2013/0306318 A1 11/2013 Frosell et al.
2014/0238657 A1 8/2014 Sladic et al.
2015/0285038 A1* 10/2015 Yeh ..... E21B 43/04 166/278

OTHER PUBLICATIONS

International Search Report and Written Opinion for Application No. PCT/US2017/045325 dated May 3, 2018.

* cited by examiner

EROSIVE SLURRY DIVERTER

BACKGROUND

In subterranean wellbore drilling operations, fine particulate materials may be produced during the production of hydrocarbons from a wellbore, which may be an unconsolidated and/or loosely consolidated formation. Numerous problems may occur as a result of the production of such particulates. For example, the particulates cause abrasive wear to components within the wellbore, such as tubing, pumps and valves. In addition, the particulates may partially or fully clog the wellbore. Also, if the particulate matter is produced to the surface, it must be removed from the hydrocarbon fluids using surface processing equipment.

One method for preventing the production of such particulate material to the surface is gravel packing the wellbore adjacent to the unconsolidated and/or loosely consolidated production interval. In a gravel packing operation, a gravel packing system may be lowered into the wellbore on a conveyance to a position proximate the desired production area. A fluid slurry including a carrier fluid and a particulate material, which is typically sized and graded and which may be referred to as gravel in the disclosure, is then pumped down the conveyance and into the annulus of the wellbore, formed between the gravel packing system and the perforated wellbore casing or open hole production zone.

The fluid slurry, however, may erode the wellbore and/or formation around the gravel packing system as the fluid slurry is discharged from the gravel packing system. Additionally, the fluid slurry may not flow out evenly from the gravel packing system and may erode the gravel packing system as the fluid slurry builds up within the gravel packing system unevenly. Therefore a device and method that is capable of discharging the fluid slurry from the gravel packing system in a manner to prevent erosion of the wellbore and/or formation as well as the gravel packing system itself may be desirable.

BRIEF DESCRIPTION OF THE DRAWINGS

These drawings illustrate certain aspects of the present disclosure, and should not be used to limit or define the disclosure.

DETAILED DESCRIPTION

The present disclosure relates generally to a system and method for subterranean operations. More particularly, a system and method for discharging gravel in gravel packing operations. The disclosure describes a system and method for discharging gravel evenly across a wellbore and/or open hole, which may prevent degradation of the wellbore, open hole, and/or gravel packing system. A gravel packing system may include a number of modular sections that may be utilized in the transportation and discharge of a fluid slurry.

Certain examples of the present disclosure may be implemented at least in part with an information handling system. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components.

Alternatively, systems and methods of the present disclosure may be implemented, at least in part, with non-transitory computer-readable media. Non-transitory computer-readable media may include any instrumentality or aggregation of instrumentalities that may retain data and/or instructions for a period of time. Non-transitory computer-readable media may include, for example, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Figure 1:
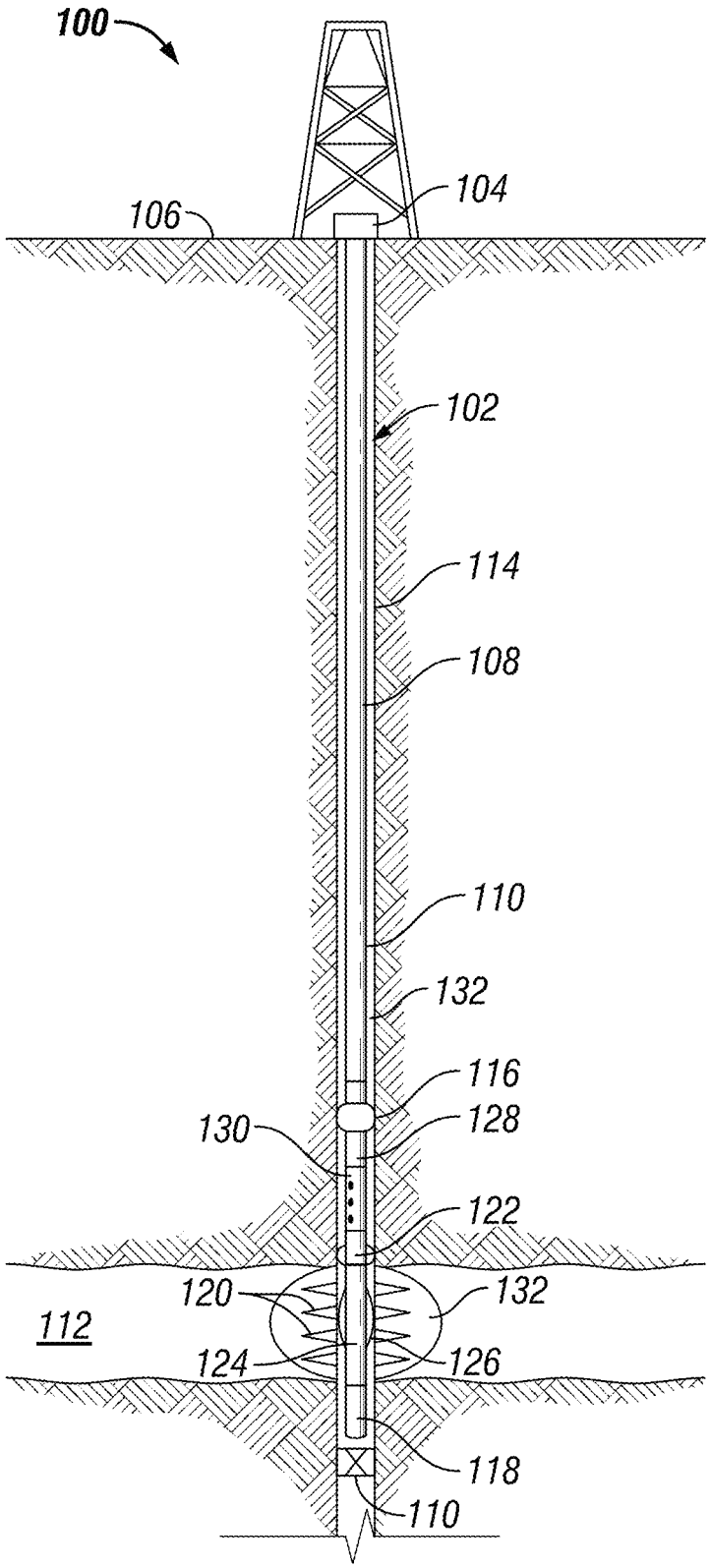
FIG. 1 an example of a gravel packing system.

FIG. 1 illustrates a gravel packing system 100. Gravel packing may be necessary for formations that are unconsolidated. In formations of this type, the formation particulates may be poorly cemented to each other or in extreme cases, not cemented at all. In these formations, formation particulates may flow into the well alongside formation fluids. A gravel pack puts sized solid particulates, sometimes referred to as gravel, between the formation and the outside of a screen placed in a well. As used herein, gravel pack should be understood to be, without limitation, any type of solid particulate in any size range that may serve the function of screening formation particulates such that the amount of formation particulates that may be produced are reduced. The solid particulates may be sized such that all but the finest formation particles may be prevented from flowing through the gravel pack. It should be noted that gravel packing may be combined with hydraulic fracturing operations commonly referred to as "frac packing." In the discussion below, references to gravel packing is intended to also include frac packing. Gravel packing system 100, as illustrated, may be a land based operation, however, it should be noted that gravel packing system 100 may operate in offshore platforms. Additionally, gravel packing system 100 may operate in horizontal, vertical, slanted, curved, and other types of wellbore geometries and orientations. As illustrated in FIG. 1, wellbore 102 may include a wellhead 104 disposed on surface 106 in which conveyance 108 may extend in to wellbore 102. Wellbore 102 may be cased and/or uncased.

In a cased well, a base 110 may be disposed at an end of wellbore 102 opposite surface 106. In examples, base 110 may include a packer or plug which prevents formation fluids and gravel from flowing to the bottom of the wellbore. A packer may be set by a wireline or other conveyance method. In an open hole application, base 110 may include a cement plug and a bull plug positioned above the cement plug. In the case of multiple gravel packs, a seal assembly including a sump packer may provide zonal isolation between the gravel packs and prevents gravel from accumulating in the bottom of the well during gravel packing.

Wellbore 102 may extend through the various earth strata including formation 112. A casing 114 may be cemented within wellbore 102. Conveyance 108 may be a tubular string, such as a work string or production tubing, that includes various tools for gravel packing operations. A packer 116 may be coupled to conveyance 108 to form a barrier, which may prevent the movement of fluid up and/or down wellbore 102. Packer 116 provides zonal isolation between a gravel pack and wellbore 102 above the gravel pack during placement of the gravel pack and production. A perforator 118 may be disposed at the end of conveyance 108. Perforator 118 may make perforations 120 into casing 114. A blank pipe 122 may be placed above production screen 124. Blank pipe 122 may ensure that production screen 124 remains packed in the event of gravel pack settling. Production screen 124 may include sized perforations to allow formation fluids to pass though while minimizing the amount of solid particulate passing though. However, it should be understood that present techniques may also be performed with screenless gravel pack operations. Centralizers 126 ensure production screen 124 and blank pipe 122 remain centered during gravel pack placement. It should be understood that the equipment shown in FIG. 1 is merely illustrative of an example gravel packing operation and that other configurations of gravel packing system 100 may be used in accordance with the present techniques.

Several gravel pack service tools may be conveyed downhole to perform gravel pack operations. The gravel pack service tools may be removed from wellbore 102 after gravel packing operations. During gravel packing operations, a fluid slurry may be disposed into conveyance 108 from surface 106. The fluid slurry may traverse down conveyance 108 to packer 116. A crossover assembly 128 may allow the fluid slurry to bypass packer 116. The fluid slurry may then enter downhole tool 130. Downhole tool 130 may operate to discharge the fluid slurry into casing 114. The fluid slurry may travel from casing 114, out perforations 120 and into wellbore 102. In an open hole without casing 114, the fluid slurry may exit downhole tool 130 and into wellbore 102. A fluid slurry may enter the top of downhole tool 130 and may exit out of the side of downhole tool 130. The fluid slurry may include a carrier fluid and solid particulate, which may collect in wellbore 102 and/or formation 112 and may form gravel deposit 132.

A fluid slurry may include a carrier fluid and/or a particulate. In examples, the carrier fluid may be any of a variety of suitable fluids for suspending the degradable thermoplastic particulates, including slickwater fluids, aqueous gels, foams, emulsions, and viscosified surfactant fluids. Without limitation, the carrier fluid may also be referred to herein as a fracturing fluid and/or a proppant-laden fracturing fluid. Suitable slickwater fluids may generally be prepared by addition of small concentrations of polymers (referred to as "friction reducing polymers") to water to produce what is known in the art as "slickwater." Suitable aqueous gels may generally include an aqueous fluid and one or more gelling agents. An aqueous gel may be formed by the combination of an aqueous fluid and coated particulates where the partitioning agent includes a gelling agent. Emulsions may include two or more immiscible liquids such as an aqueous gelled liquid and a liquefied, normally gaseous fluid, such as nitrogen. Treatment fluids suitable for use in accordance with this disclosure may be aqueous gels that include an aqueous fluid, a gelling agent for gelling the aqueous fluid and increasing its viscosity, and optionally, a cross-linking agent for cross-linking the gel and further increasing the viscosity of the fluid. The cross-linking agent may be provided as a component of the partitioning agent on the coated particulates and may be introduced into the aqueous gel by the combination of the coated particulates with an aqueous fluid. The increased viscosity of the gelled or gelled and cross-linked treatment fluid, among other things, may reduce fluid loss and may allow the fracturing fluid to transport significant quantities of suspended particulates. The treatment fluids also may include one or more of a variety of well-known additives such as breakers, stabilizers, fluid loss control additives, clay stabilizers, bactericides, and the like.

Without limitation, the carrier fluid may include an aqueous-base fluid, which may be fresh water, saltwater (e.g., water containing one or more salts dissolved therein), brine (e.g., saturated saltwater), or seawater. Generally, the aqueous-base fluid may be from any source provided that it does not contain an excess of compounds that may adversely affect other components in the spacer fluid. Generally, the aqueous-base fluid may be present in the carrier fluids in an amount in the range of from about 45% to about 99.98% by volume of the carrier fluid. For example, the aqueous-base fluid may be present in the carrier fluids in an amount in the range of from about 65% to about 75% by volume of the carrier fluid.

The carrier fluid may include any number of additional additives, including, but not limited to, salts, surfactants, acids, fluid loss control additives, gas, foamers, corrosion inhibitors, scale inhibitors, catalysts, clay control agents, biocides, friction reducers, antifoam agents, bridging agents, dispersants, flocculants, $H_2S$ scavengers, $CO_2$ scavengers, oxygen scavengers, lubricants, gelling agents, breakers, weighting agents, particulate materials (e.g., proppant particulates) and any combination thereof. With the benefit of this disclosure, one of ordinary skill in the art should be able to recognize and select suitable additives for use in the carrier fluid.

In examples, a particulate may include, but is not limited to, sand, bauxite, ceramic materials, glass materials, polymer materials, polytetrafluoroethylene materials, nut shell pieces, cured resinous particulates including nut shell pieces, seed shell pieces, cured resinous particulates including seed shell pieces, fruit pit pieces, cured resinous particulates including fruit pit pieces, wood, composite particulates, and combinations thereof. Suitable composite particulates may include a binder and a filler material wherein suitable filler materials include silica, alumina, fumed carbon, carbon black, graphite, mica, titanium dioxide, meta-silicate, calcium silicate, kaolin, talc, zirconia, boron, fly ash, hollow glass microspheres, solid glass, and combinations thereof. Without limitation, the particulates may include graded sand. Other suitable particulates that may be suitable for use in subterranean applications may also be useful. Without limitation, the particulates may have a particle size in a range from about 2 mesh to about 400 mesh, U.S. Sieve Series. By way of example, the particulates may have a particle size of about 10 mesh to about 70 mesh with distribution ranges of 10-20 mesh, 20-40 mesh, 40-60 mesh, or 50-70 mesh, depending, for example, on the particle sizes of the formation particulates to be screen out. The particulates may be carried by the carrier fluid. Without limitation, the particulates may be present in the carrier fluid in a concentration of about 0.1 pounds per gallon (0.012 g/cm$^3$) to about 10 ppg (1.2 g/cm$^3$), about 0.2 ppg (0.024 g/cm$^3$) to about 6 ppg (0.72 g/cm$^3$). These ranges encompass every number in between, for example. For example, the concentration may range between about 0.5 ppg (0.06 g/cm$^3$) to about 4 ppg (0.48 g/cm$^3$). One of ordinary skill in the art with the benefit of this disclosure should be able to select an appropriate amount of the particulates to use for a particular application. The fluid slurry may travel through conveyance 108 from surface 106 (referring to FIG. 1) to any desirable location within casing 114 and/or wellbore 102. In examples, the fluid slurry may exit downhole tool 130.

Figure 2A:
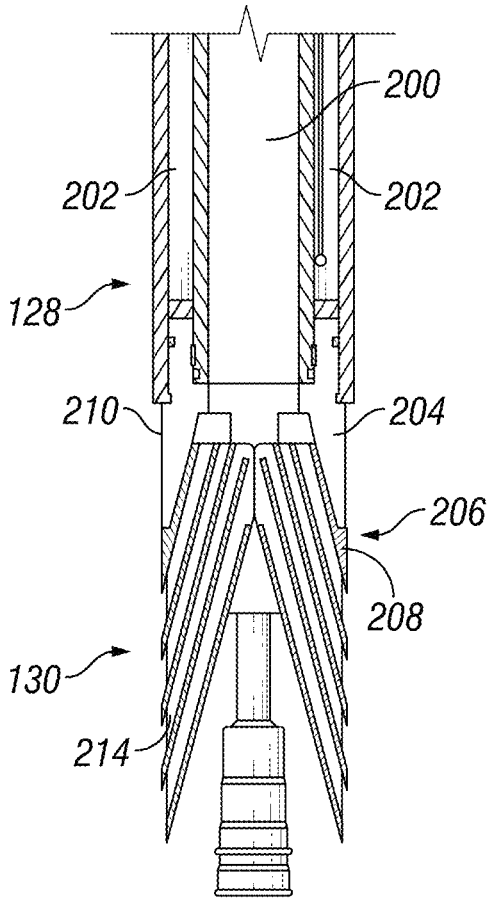
FIG. 2*a* is an example of cutaway view of a crossover assembly and a downhole device.
Figure 2B:
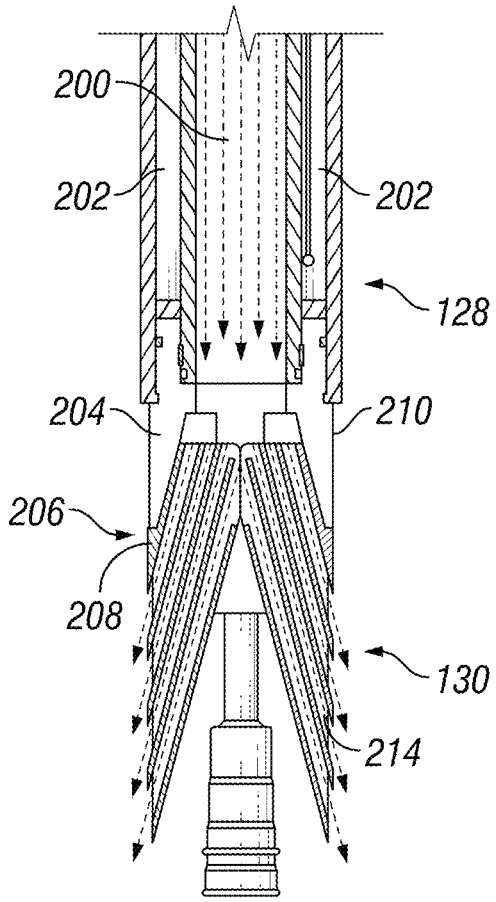
FIG. 2*b* is an example of a flow path through a crossover assembly and the downhole device.

FIGS. 2*a* and 2*b* illustrate a cut away view of at least a portion of downhole tool 130 and crossover assembly 128. It should be noted that FIGS. 2*a* and 2*b* illustrate downhole tool 130 and crossover assembly 128 attached to each other, however, crossover assembly 128 and downhole tool 130 may not be attached to each other. In examples, there may be additional pipe and/or tools disposed between crossover assembly 128 and downhole tool 130. Crossover assembly 128, as disclosed above in FIG. 1, may be disposed in casing 114 at packer 116. Crossover assembly 128 may act as a "bridge" that may control the flow of fluids up and down casing 114 past packer 116 (e.g., referring to FIG. 1). As illustrated in FIG. 2*a*, a first passage 200 may allow for the flow of fluids to traverse from surface 106 (e.g., referring to FIG. 1) down conveyance 108 and bypass packer 116. A second passage 202 may be disposed radially around first passage 200. Second passage 202 may allow for the flow of fluids from wellbore 102 and/or casing 114 to move to surface 106 and bypass packer 116. It should be noted that the flow of fluids within in first passage 200 and/or second passage 202 may change depending on the particular method and/or use of crossover assembly 128 in wellbore 102.

Figure 3:
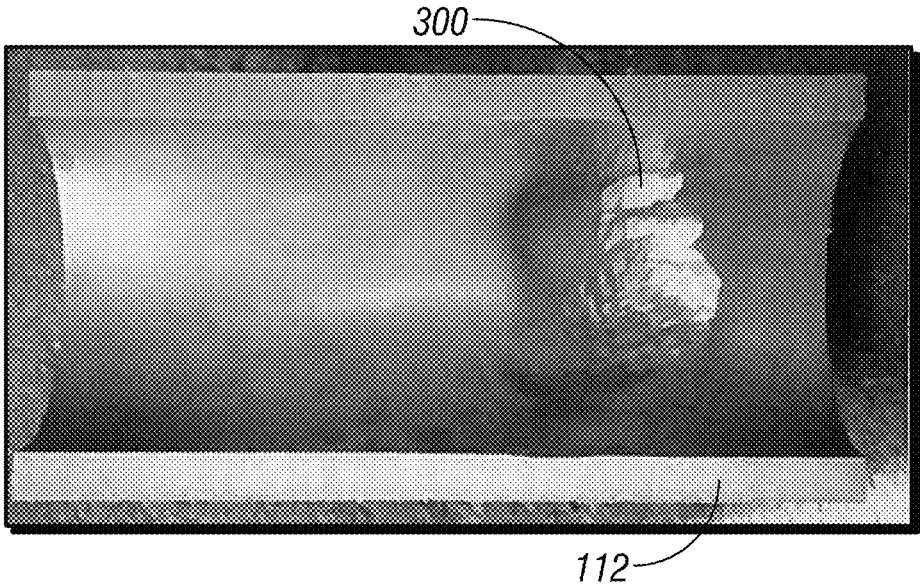
FIG. 3 is an example of an erosion zone on a casing.
Figure 4:
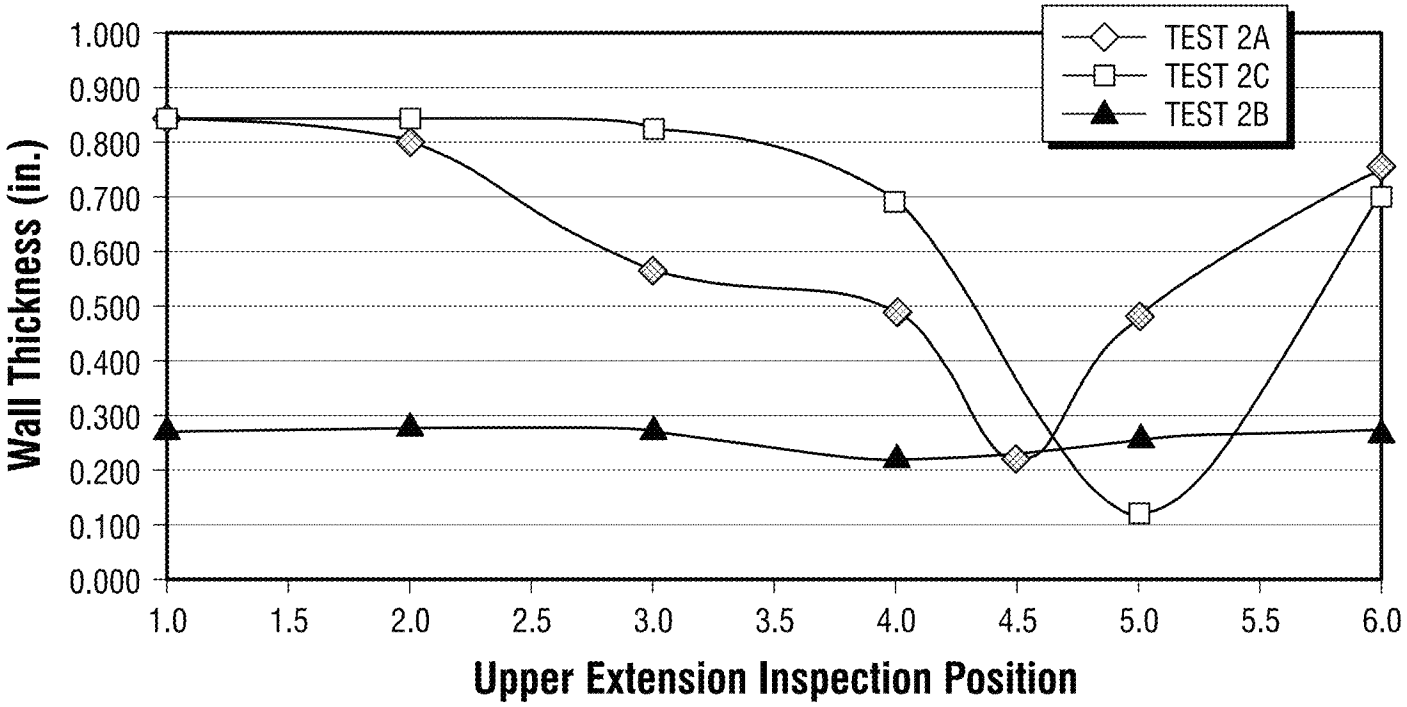
FIG. 4 is a graph of erosion at selected locations along a casing.

During gravel packing operations, a fluid slurry may be disposed downhole from surface 106 (e.g., referring to FIG. 1). As illustrated in FIG. 2*b*, the fluid slurry may traverse down conveyance 108 (e.g., referring to FIG. 1), through crossover assembly 128, and may enter downhole tool 130. Downhole tool 130, as illustrated in FIGS. 2*a* and 2*b*, may include a body 204 and a diverter 208 disposed in the body 204. Body 204 may include an outer wall 210. The flow of the fluid slurry (as illustrated by arrows in FIG. 2*b*) in downhole tool 130 may enter diverter 208. Diverter 208 may push the fluid slurry that enters downhole tool 130 into casing 114 and/or wellbore 102 (e.g., referring to FIG. 1). In conventional methods, a downhole assembly may use holes disposed along an outer wall to allow for the fluid slurry to move out of the downhole assembly and into casing 114 and/or wellbore 102. Varying hole sizes were utilized to help distribute flow out of the downhole assembly. This has been found to be generally ineffective as the inertia of the fluid slurry does not allow the fluid slurry to move out of the downhole assembly until it is forced out due to a buildup of the fluid slurry within the downhole assembly. In these conventional methods, the buildup of the fluid slurry and the force required to move the fluid slurry out of the downhole assembly could erode the holes in the downhole assembly. Additionally, the large buildup of the fluid slurry would lead to the fluid slurry coming out of a single hole in the downhole assembly with large amounts of force. As illustrated in FIG. 3, casing 114 (e.g., referring to FIG. 1), may erode from the large amount of the fluid slurry striking casing 114 with force. This may form an erosion zone 300, which may damage and/or puncture casing 114. Further illustrated in FIG. 4, a graph plots the location of erosion over the length of the prior art downhole tool. The graph shows that the max erosion occurs near the bottom of the downhole tool and is centered at one location. In examples, erosion zone 300 may be amplified as the holes in prior art downhole tools begin to erode. To prevent erosion on casing 114 and/or downhole tool 130, diverters 208 may be disposed within downhole tool 130 to prevent the buildup of the fluid slurry within downhole tool 130.

As illustrated in FIG. 2*a*, there may be a single diverter 208 and/or a plurality of diverters 208 disposed in body 204 of downhole tool 130. In examples, diverter 208 may be manufactured from the same material as conveyance 108. It may be manufactured from an alternative material that has a higher hardness than the material in conveyance 108. The alternative material may be a different heat treatment of the steel in conveyance 108, a different alloy of steel, a coating on the steel, a ceramic, or a metal-matrix composite. In examples, metal-matrix composite may comprise disposing ceramic components into a metal binder, wherein the ceramic may be particles, fivers, weaves, plates, and/or the like. The ceramic may be constructed from zirconia (including zircon), alumina (including fused alumina, chrome-alumina, and emery), carbide (including tungsten carbide, silicon carbide, titanium carbide, and boron carbide), boride (including boron nitride, osmium diboride, rhenium boride, and tungsten boried), nitride (including silica nitride), synthetic diamond, and silica. The ceramic can be an oxide (like the alumina and zirconia) or a non-oxide (like the carbide, nitride, and boride).

In examples, body 204 may include on one more openings 206 into which diverters 208 may be disposed. Openings 206 may extend from outer wall 210 of body 204 into first passage 200. To prevent erosion, diverter 208 may extend from outer wall 210 of body 204 into the flow path of first passage 200, wherein first passage 200 may extend from crossover assembly 128 and into downhole tool 130. In conventional methods, a ball (not illustrated, would traverse first passage 200, which would extend the length of gravel packing system 100. Thus, to allow the ball to traverse the length of gravel packing system 100 through first passage 200, devices and/or assemblies could not block first passage 200. As disclosed, a ball may not be required in gravel packing system 100, thus, diverter 208 may extend into first passage 200. As illustrated in FIG. 2*b*, flow path 212 (indicated by arrows) may allow the fluid slurry to traverse through crossover assembly 128 and into downhole tool 130, through first passage 200, into diverter 208, and out of downhole too 1130. In examples, diverter 208 may be open and/shut by an information handling system (not illustrated) that may be disposed on surface 106 (referring to FIG. 1) and/or downhole tool 130. The information handling system may open and/or close valves (not illustrated) that may be disposed at the entrance and/or the exit of diverter 208. As illustrated in FIGS. 2*a* and 2*b*, diverter 208 may include individual channels 214, which may evenly disperse the fluid slurry across diverter 208. Individual channels 214 may be larger and/or smaller than their adjacent channels, which may control the volume and/or flow rate of the fluid slurry across diverter 208. As illustrated, FIGS. 2*a* and 2*b* show a single diverter 208 and/or set of diverters 208 at a single level. However, it should be noted that diverters 208 may be disposed at multiple levels along the length of downhole tool 130.

Figure 5A:
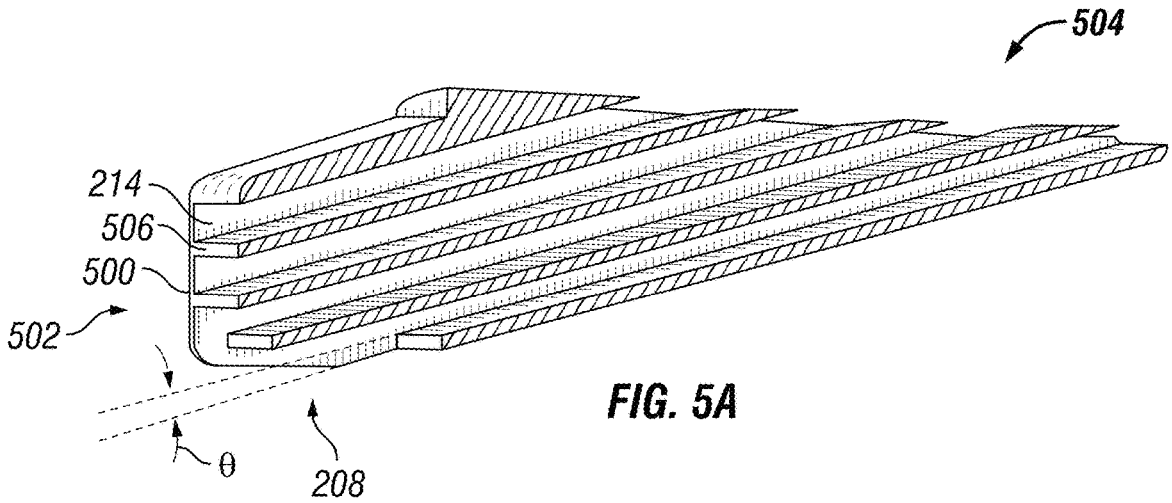
FIG. 5*a* is an example of a cut away view of a diverter.
Figure 5B:
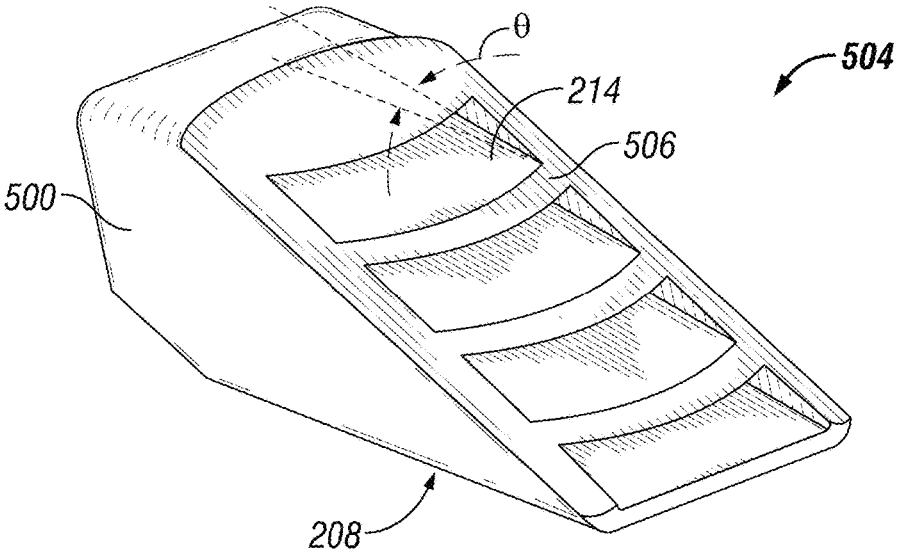
FIG. 5*b* is an example of the diverter viewed from the exit.
Figure 5C:
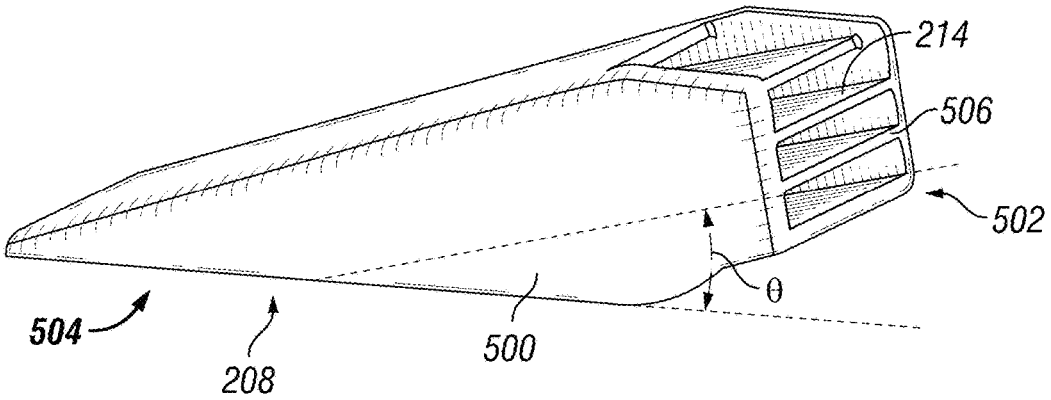
FIG. 5*c* is an example of the diverter viewed from the entrance.

FIGS. 5*a*-5*c* illustrate different views of diverter 208 (Referring to FIG. 2*a* and FIG. 2*b*). As illustrated diverter 208 may comprise housing 500. Housing 500 may comprise a first end 502 and a second end 504. Housing 500 may taper from first end 502 to second end 504. In embodiments, first end 502 may be disposed in first passage 200 (i.e. referring to FIG. 2*a* and FIG. 2*b*) and second end 504 may be disposed at opening 206 (i.e. referring to FIG. 2*a* and FIG. 2*b*). Channel 214 (Referring to FIG. 2*a* and FIG. 2*b*) may traverse the length of housing 500 from first end 502 to second end 504. Without limitation, there may be a plurality of channels 214, which may be stacked adjacent to each other in any direction and at any angle. Channels 214 may be separated by fins 506. Fins 506 may be disposed the length of channel 214. In examples, fins 506 and housing 500 may form the outer boundaries of channel 214. Without limitation, the outer boundaries of channel 214 may include only fins 506 and/or only housing 500. Fins 506 may be beveled at first end 502 and/or second end 504. In examples, fins 506 may bend in any direction, which may change the direction and/or flow of channel 214. Without limitation, fins 506 may be removable from diverter 208. In examples, individual fins 506 may be removable to replace broken fins 506 and/or re-direct the flow through diverter 208.

It should be noted that diverter 208 may be removable from downhole tool 130 (Referring to FIG. 2*a* and FIG. 2*b*). Openings 206 (Referring to FIG. 2) may allow for diverter 208 and/or a plurality of diverters 208 to be inserted and/or removed from downhole tool 130. For example, different types of diverter 208 may be interchangeable with downhole tool 130, this may allow an operator to choose a diverter 208 that may be suited for different downhole environments. This may also allow an operator to remove diverters 208 that may be broke and need replacing. Diverters 208 may attach to downhole tool 130 (Referring to FIG. 1) by any suitable means, for example, nuts and bolts, screws, press fittings, adhesive, and the like. It should be noted that channels 214 may be stacked adjacent to each other in any suitable manner. Housing 500, as illustrated in FIG. 5*b*, may be sloped to match the outside profile of downhole tool 130. Diverter 208 may be angled about sixty degrees. In examples, diverter 208 may be angled between about 5 degrees and/or about ninety degrees. In examples, channel 214 may further include an angle θ between about five degrees and about ninety degrees. As illustrated in FIG. 5*c*, the front of diverter 208 may include larger and/or smaller entrances to channels 214, which may control the volume and flow of the fluid slurry through each channel 214. It should be noted that channels 214 may be inserted into downhole tool 130 individually.

This disclosure may include any of the various features of the compositions, methods, and systems disclosed herein, including one or more of the following features in any combination.

Statement 1: A downhole tool comprising: a body comprising an outer wall and a first passage that extends longitudinally in the body, wherein a fluid slurry traverses a flow path in the body of the downhole tool through the first passage; and a diverter disposed in the body, wherein the diverter comprises at least one channel and the diverter extends from the outside wall of the body into the flow path of the first passage operable to direct the fluid slurry from the first passage to a location outside the downhole tool.

Statement 2: The downhole tool of statement 1, further comprising a plurality of diverters.

Statement 3: The downhole tool of statement 1 or statement 2, wherein the plurality of diverters are disposed at different levels.

Statement 4: The downhole tool of any preceding statement, wherein the diverter comprises a plurality of channels.

Statement 5: The downhole tool of any preceding statement, wherein the plurality of channels are different sizes.

Statement 6: The downhole tool of any preceding statement, wherein an entrance or an exit of the diverter further comprises a valve and wherein the valve is openable and closable.

Statement 7: The downhole tool of any preceding statement, wherein the diverter is removable from the downhole tool.

Statement 8: The downhole tool of any preceding statement, wherein the downhole tool comprises at least one opening and the diverter is disposed in the at least one opening.

Statement 9: The downhole tool of any preceding statement, wherein the diverter comprises a housing, wherein the housing is tapered from a first end to a second end.

Statement 10: The downhole tool of any preceding statement, wherein the housing comprises at least one fin, wherein the at least one fin and the housing form boundaries of the at least one channel.

Statement 11: The downhole tool of any preceding statement, wherein the fin is tapered from the first end to the second end of the housing.

Statement 12: A gravel packing system comprising: a packer; a conveyance comprising a downhole tool, wherein the downhole tool comprises: a body comprising an outer wall and a first passage that extends longitudinally in the body, wherein a fluid slurry traverses a flow path in the body of the downhole tool through the first passage; and a diverter disposed in the body, wherein the diverter comprises at least one channel and the diverter extends from the outside wall of the body into the flow path of the first passage operable to direct the fluid slurry from the first passage to a location outside the downhole tool.

Statement 13: The gravel packing system of statement 12, wherein the diverter comprises a plurality of channels.

Statement 14: The gravel packing system of statement 12 or statement 13, wherein the plurality of channels are different sizes.

Statement 15: The gravel packing system of statements 12-14, wherein the downhole tool comprises at least one opening and the diverter is disposed in the at least one opening.

Statement 16: The gravel packing system of statements 12-15, wherein the diverter comprises a housing, wherein the housing is tapered from a first end to a second end.

Statement 17: A method for discharging gravel comprising: directing a fluid slurry through a conveyance disposed in a wellbore and into a first passage in a downhole tool disposed on the conveyance, wherein the fluid slurry comprises gravel; and diverting the fluid slurry from the first passage to a location outside the downhole tool with a diverter that extends from an outer wall of the downhole tool into the first passage.

Statement 18: The method of statement 17, further comprising packing the gravel in the wellbore.

Statement 19: The method of statement 17 or statement 18, wherein the directing the fluid slurry comprises directing the fluid slurry through channels in the diverter.

Statement 20: The method of statements 17-19, wherein the diverter is tapered from the first passage to the outer wall.

The preceding description provides various examples of the systems and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "including," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present examples are well adapted to attain the ends and advantages mentioned as well as those that are inherent therein. The particular examples disclosed above are illustrative only, and may be modified and practiced in different but equivalent manners apparent to those skilled in the art having the benefit of the teachings herein. Although individual examples are discussed, the disclosure covers all combinations of all of the examples. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative examples disclosed above may be altered or modified and all such variations are considered within the scope and spirit of those examples. If there is any conflict in the usages of a word or term in this specification and one or more patent(s) or other documents that may be incorporated herein by reference, the definitions that are consistent with this specification should be adopted.

What is claimed is:

1. A downhole tool comprising:

a body comprising an outer wall and a first passage that extends longitudinally in the body, wherein a fluid slurry traverses a flow path in the body of the downhole tool through the first passage; and a diverter disposed in the body, wherein the diverter comprises at least one channel and the diverter extends from the outside wall of the body into the flow path of the first passage operable to direct the fluid slurry from the first passage to a location outside the downhole tool, wherein the diverter comprises a housing, wherein the housing comprises at least one fin.

2. The downhole tool of claim 1, further comprising a plurality of diverters.

3. The downhole tool of claim 2, wherein the plurality of diverters are disposed at different levels.

4. The downhole tool of claim 1, wherein the diverter comprises a plurality of channels.

5. The downhole tool of claim 4, wherein the plurality of channels are different sizes.

6. The downhole tool of claim 1, wherein an entrance or an exit of the diverter further comprises a valve and wherein the valve is openable and closable.

7. The downhole tool of claim 1, wherein the diverter is removable from the downhole tool.

8. The downhole tool of claim 7, wherein the downhole tool comprises at least one opening and the diverter is disposed in the at least one opening.

9. The downhole tool of claim 1, wherein the housing is tapered from a first end to a second end.

10. The downhole tool of claim 9, wherein the at least one fin and the housing form boundaries of the at least one channel.

11. The downhole tool of claim 10, wherein the fin is tapered from the first end to the second end of the housing.

12. A gravel packing system comprising:

a packer;

a conveyance comprising a downhole tool, wherein the downhole tool comprises:

a body comprising an outer wall and a first passage that extends longitudinally in the body, wherein a fluid slurry traverses a flow path in the body of the downhole tool through the first passage; and a diverter disposed in the body, wherein the diverter comprises at least one channel and the diverter extends from the outside wall of the body into the flow path of the first passage operable to direct the fluid slurry from the first passage to a location outside the downhole tool, wherein the diverter comprises a housing, wherein the housing comprises at least one fin.

13. The gravel packing system of claim 12, wherein the diverter comprises a plurality of channels.

14. The gravel packing system of claim 13, wherein the plurality of channels are different sizes.

15. The gravel packing system of claim 12, wherein the downhole tool comprises at least one opening and the diverter is disposed in the at least one opening.

16. The gravel packing system of claim 12, wherein the housing is tapered from a first end to a second end.

17. A method for discharging gravel comprising:

directing a fluid slurry through a conveyance disposed in a wellbore and into a first passage in a downhole tool disposed on the conveyance, wherein the fluid slurry comprises gravel; and diverting the fluid slurry from the first passage to a location outside the downhole tool with a diverter that extends from an outer wall of the downhole tool into the first passage, wherein the diverter comprises a housing, wherein the housing comprises at least one fin.

18. The method of claim 17, further comprising packing the gravel in the wellbore.

19. The method of claim 17, wherein the directing the fluid slurry comprises directing the fluid slurry through channels in the diverter.

20. The method of claim 17, wherein the diverter is tapered from the first passage to the outer wall.

* * * * *